US006820679B1

(12) United States Patent
Lutze

(10) Patent No.: US 6,820,679 B1
(45) Date of Patent: Nov. 23, 2004

(54) METHOD OF PRIMARY FORMING A MATERIAL

(75) Inventor: Peter Lutze, Soltau (DE)

(73) Assignee: DRM Druckguss GmbH, Bebra-Iba (DE)

( * ) Notice: Subject to any disclaimer, the term of this patent is extended or adjusted under 35 U.S.C. 154(b) by 0 days.

(21) Appl. No.: 10/110,177

(22) PCT Filed: Oct. 10, 2000

(86) PCT No.: PCT/DE00/03538

§ 371 (c)(1),
(2), (4) Date: Sep. 12, 2002

(87) PCT Pub. No.: WO01/28713

PCT Pub. Date: Apr. 26, 2001

(30) Foreign Application Priority Data

Oct. 16, 1999 (DE) ..... 199 50 037

(51) Int. Cl.[7] ..... B22D 11/08; B22D 27/02; B22D 27/04

(52) U.S. Cl. ..... 164/457; 164/113; 164/492; 164/250.1; 164/312

(58) Field of Search ..... 164/457, 458, 164/154.6, 113, 303–318, 492, 250.1

(56) References Cited

FOREIGN PATENT DOCUMENTS

| | | | |
|---|---|---|---|
| CH | 267159 | | 3/1950 |
| DE | 41 26 175 A 1 | | 8/1991 |
| DE | 41 32 732 A 1 | | 10/1991 |
| DE | 195 45 177 A1 | | 12/1995 |
| DE | 196 37 844 A 1 | | 9/1996 |
| DE | 198 25 223 A 1 | | 6/1998 |
| EP | 0 815 993 A1 | | 1/2000 |
| EP | 0 968 781 A2 | | 1/2000 |
| GB | 114790 | | 4/1918 |
| GB | 685182 | | 12/1952 |
| GB | 2 103 974 A | | 3/1983 |
| GB | 2 160 456 A | | 12/1985 |
| JP | 55-54255 | * | 4/1980 |
| WO | WO 93/22088 | | 11/1998 |

OTHER PUBLICATIONS

Quirmbach et al.; "Rheocasting—Eine Herausforderung an keramische Formwerkzeuge"; Keramische Zeltschrift; 1995; pp. 891–897.

Aluminum—70. Jahrgang 1994—5/6; pp. 346–351.

* cited by examiner

*Primary Examiner*—Kuang Y. Lin
(74) *Attorney, Agent, or Firm*—Whitham, Curtis & Christofferson, P.C.

(57) ABSTRACT

The invention relates to a method according to which a metal (13) is re-shaped by a primary forming process. The aim of the invention is to improve such a method so that heat can be relatively easily added to the part and so that the addition can be varied as regards space and time. To this end, a voltage is applied to parts of the primary forming device between which the metal is disposed during the insertion process and/or during the primary forming process and/or during a subsequent treatment in the primary form after the primary forming process so that a closed circuit is produced and heat energy is supplied to the metal by the closed circuit.

26 Claims, 1 Drawing Sheet

METHOD OF PRIMARY FORMING A MATERIAL

BACKGROUND OF THE INVENTION

The invention relates to a method of primary forming a material in which a metal is re-shaped in a primary forming operation.

Primary forming methods of this type comprise, inter alia, casting methods such as pressure-diecasting, gravity-diecasting and sand-casting methods, and also forging and drop-forging methods, in which a metal is re-shaped.

In such primary forming methods, the temperature development of the metal is important for better workability and desired microstructural formation. In particular in the case of casting methods in which a liquid metal or (in the case of thixo casting or solid state melting) pasty or softened solid metal solidifies in the primary mold, it is advantageous to control the temperature variation of the metal. For controlling the temperature variation, it is known, for example from DE 195 45 177 A1, to supply heat to the workpiece or metal inductively by an electromagnetic field which is variable over time. In this way, a defined amount of heat can be introduced into the workpiece, it being possible for the locational and temporal distribution of the inductive field to be varied. The changing of the electromagnetic field can in this case be made dependent on the re-shaping state of the workpiece.

Such inductive heating of a workpiece is already enough to avoid local solidification and undesired premature cooling of the workpiece. However, the inductive coupling-in of the electromagnetic waves can be problematical when relatively large molds are used, for example of a relatively large pressure diecasting installation with metallic mold halves, since the electromagnetic field that changes or oscillates over time has the effect of also inducing eddy currents in the mold halves.

SUMMARY OF THE INVENTION

The invention is based on the object of providing improvements over the prior art and, in particular, of providing novel primary forming methods with which heat can be supplied relatively easily to a metal in a desired way, it advantageously being possible for the supply of heat to be varied in terms of space and time.

This object is achieved according to the invention by a conductively generated voltage being applied to parts of the primary forming device during a filling operation before the primary forming operation and/or during the primary forming operation and/or during a subsequent treatment in the primary mold after the primary forming operation, in such a way that a closed circuit is formed and thermal energy is supplied to the metal conductively, with the closed circuit running through the metal.

According to the invention, the metal is consequently heated conductively, i.e. an electric current is passed through the metal. For this purpose, according to the invention, a voltage is applied to parts suitable for this of the molds between which the metal is located or the primary forming device used.

Conductive heating of this type can be achieved with relatively simple apparatus in comparison with inductive heating, by connecting a current source suitable for this to the desired parts of the device. A welding current source which can deliver the desired high current intensities of, for example, greater than/equal to 100 A at the desired voltage of, for example, less than/equal to 100 V may be used for example as the current source.

According to the invention, the voltage can be input in particular at components which have a large contact surface with the metal, such as for example in the case of a casting device the casting plunger, the casting chamber or mold halves, so that a relatively uniform supply of heat to the metal can be achieved. Since, with increasing temperature, the electrical resistance of the metal likewise increases, a natural inverse feedback occurs in the metal, so that, when there is stronger heating of some regions of the metal, the resistance increases and the current flows more through other, cooler regions of the metal.

The voltage can be applied in principle in all regions of the primary forming device. If metallic components are used, in the case of a pressure diecasting device, for example, the casting plunger, the casting chamber, the anvil, the mold halves or a slide, the voltage can be connected directly to these components. Furthermore, it is possible to provide in the components concerned electrodes for the connection of the voltage source, which according to the invention represent parts of the primary forming device. Use of electrodes may, for example, be meaningful in mold halves which have a ceramic insulation with respect to the mold cavity.

The current may be supplied differently in individual phases of the method. In the case of a pressure diecasting method, a voltage can be advantageously applied between the casting plunger and the anvil during the filling phase, in which the molten or pasty metal is filled into the casting chamber, so that a current is generated through the metal over the length of the casting chamber.

In this way it is possible in particular for the temperature of the metal to be kept constant; furthermore, it is possible to increase the temperature of the metal in the casting chamber, so that an unnecessarily great amount of energy is not used up in a melting phase before filling. Later heating is meaningful in particular in the case of thixo-casting methods or SMS (Solid State Melting) methods, in which a slug of a merely softened or slightly pasty metal is introduced, since unnecessary heating of the slug or keeping-warm of preheated slugs before filling can consequently be at least partially prevented.

During mold filling, a voltage can be applied in particular between the mold halves, so that the metal located in the mold cavity is heated directly between the mold halves. If the mold halves are covered on their inner side to a relatively great extent with a ceramic insulator, electrodes can be additionally used for this purpose. Metallic cooling elements fitted in the mold halves may also be used, for example, as electrodes, so that it is unnecessary for further electrodes to be fitted in existing devices. Furthermore, a current can also be generated between the casting plunger or casting chamber and one or both mold halves, so that the metal still in the casting chamber and in the gate is also heated. If slides are used for producing desired pressure diecasting molds, these can also be used as a connecting point for voltage with respect to another slide, one or both mold halves or, in particular, the casting plunger and/or casting chamber.

In the solidifying phase after mold filling, it may be advantageous in particular to keep the butt of material between the casting plunger and the anvil liquid, in order that a pressure continues to be exerted on the metal located in the mold cavity, in order to ensure good compaction or dense feeding of the metal in the mold cavity. Furthermore, it is possible, for example by a voltage between the casting plunger or casting chamber and the mold halves, or an electrode fitted in them or a slide fitted in them, to keep clear the gate which joins the space inside the casting chamber to the mold cavity, in order that the pressure exerted on the butt of material acts for a longer time on the metal located in the mold cavity.

Furthermore, by suitable current conduction in the metal, it is possible to achieve directional solidification in the mold cavity, in that cooling initially occurs in the regions of lower current intensity and then spreads from these regions into the mold cavity. Since, where there is cooling, the metal is detached from the walls of the mold halves, a sudden change in resistance occurs, which further intensifies this effect. Consequently, a detachment of the metal in the solidified regions from the mold halves and directional solidification can be gradually achieved.

After the solidifying process, a further thermal treatment, in which thermal energy is conductively supplied to the material in desired regions in a desired way, can be carried out without further aids to improve the microstructure. For this purpose, electrodes, for example cores, preferably embedded in the cast piece, can be used, whereby it is ensured that current is also supplied in regions of the metal which have become detached from the mold halves.

The method according to the invention can be carried out manually. Furthermore, the voltage or current variation can be varied in dependence on calculated or measured function curves. For this, a desired starting-up or switching-off characteristic may be implemented, for example, when raising and lowering the current intensities. According to the invention, automatic control with temperature measurement of the metal is also advantageously possible, so that the voltage or current intensity can be changed in dependence on a temperature or the temperature values measured at a number of points of the metal. This allows the temperature to be kept constant, in particular, or a lowering of the temperature of the metal to be delayed. Furthermore, another measured variable may also be measured for an automatic control procedure. This may, in particular, involve measuring an internal mold pressure between the mold halves. This measurement may take place, for example, by means of a membrane which is provided flush in the mold surface or inner face of the mold halves and is connected to a piezoelectric crystal fitted outside the mold cavity. As an alternative to this, a piezoelectric crystal may be provided under an ejector pin, so that a measurement of the internal mold pressure is possible by means of the displaceable ejector pin.

Furthermore, in addition or as an alternative to this, a sound emission, in particular an ultrasound emission of the metal, for example in the range of 100 KHZ, may be measured. A sound emission analysis of this type can be used to establish the undesired cavitation taking place during the solidifying process. An example of such sound emission analysis is shown in DE 39 40 560 C2. According to the invention, the automatic control takes place here in such a way that, when a measuring signal or excessively high measuring signal is obtained, the heating power is increased, so that the measured signal is kept to a minimal level.

BRIEF DESCRIPTION OF THE DRAWING

The invention is explained in more detail below on the basis of a number of embodiments with reference to the accompanying drawing. The figure shows the schematic construction of a pressure diecasting device in sectional representation.

DETAILED DESCRIPTION OF THE DRAWING

Figure 1:
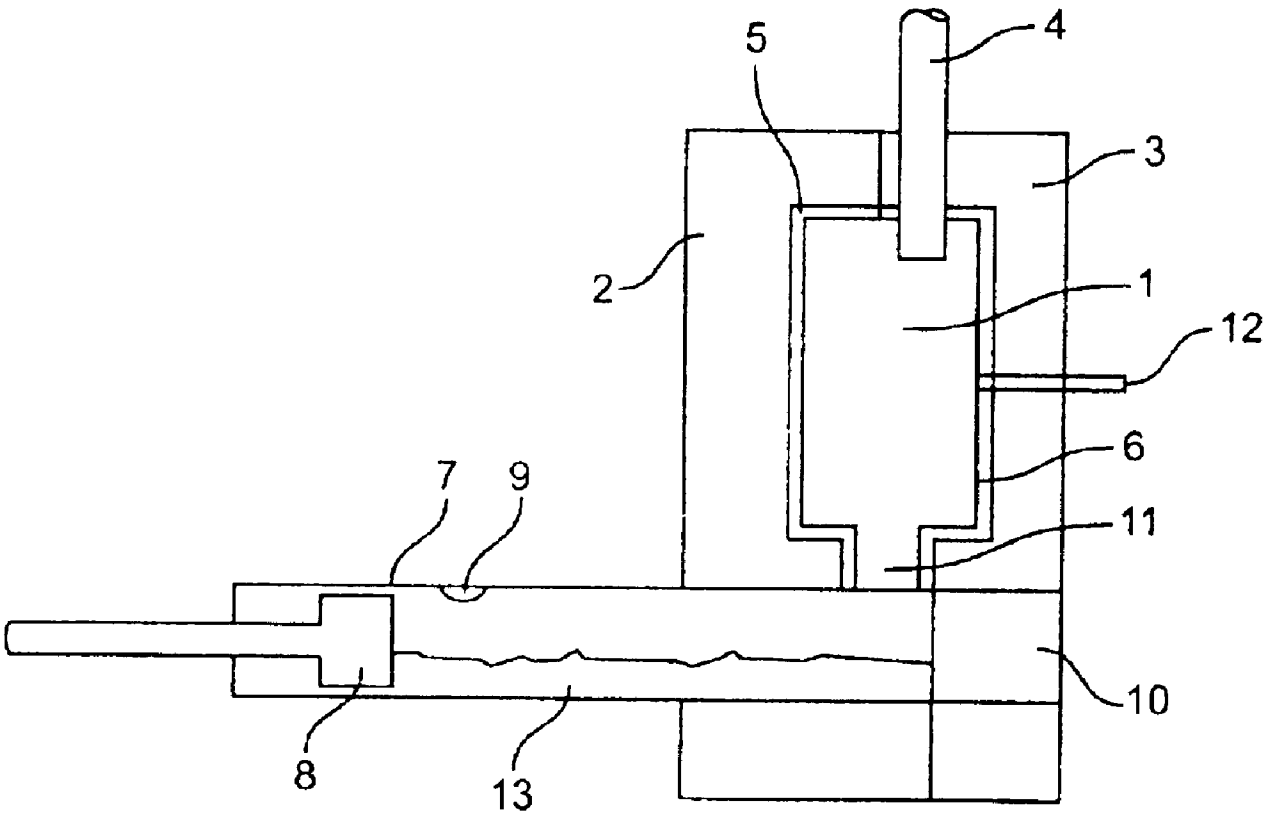

Liquid metal, for example aluminum, magnesium or an aluminum or magnesium alloy, is filled into the space inside a casting chamber 7 through a filling hole 9 during a filling phase. During this operation, the casting plunger 8 is in the withdrawn position shown in the figure. The liquid metal 13 fills the space inside the casting chamber 7 to a filling degree of, for example, 30 to 80%.

In the subsequent mold-filling phase, the casting plunger 8 is forced toward an anvil 10, so that the liquid metal 13 is forced into a mold cavity 1 between two mold halves 2 and 3 and then solidifies. Subsequently, the mold halves 2 and 3 are drawn apart and the primary-formed workpiece is consequently released. To achieve complicated geometries, a slide 4, or a number of slides, may be introduced into the mold cavity, said slides being removed before the workpiece is demolded.

According to the invention, it is provided that the workpiece is conductively heated during one, or more of these phases with the casting chamber preferably being grounded. For example, during the filling phase and after the filling phase, a current may be passed through the liquid metal 13 located in the casting chamber 7, by applying a voltage between the casting plunger 8 and the anvil 10. As a result, the effect can be achieved that an electric current flows through the entire length of the casting chamber 7. The anvil 10 may in this case be electrically insulated or not insulated with respect to the casting chamber 7. If there is electrical insulation, a possible short-circuit current from the casting plunger via the casting chamber to the anvil 10 is prevented or reduced.

In the subsequent mold-filling phase, a voltage can be applied between the casting plunger 8 and a mold half 2 or 3, so that a current flows along the liquid metal in the casting chamber and the partially or completely filled mold cavity. For this, the mold halves 2 and 3 may be connected in parallel, so that they are together connected as an electrode with respect to the casting plunger 8. This allows a uniform current distribution in the workpiece in the mold cavity 1 and consequently a uniform supply of heat to be achieved. Furthermore, it is possible, as an alternative or in addition to this, to apply a voltage between the mold halves 2 and 3, so that a current flows directly through the metal located between the mold halves and heats it. Furthermore, a voltage may also be connected between the casting chamber 7 and one or both mold halves 2, 3. It is also possible, in addition or as an alternative to this, to apply a voltage between a slide 4 and one or both mold halves 2, 3 or between the slide 4 and the casting plunger, casting chamber or anvil 10, so that a current flows through the mold cavity 1.

In the embodiments described, an electrode 12 may also be used for the voltage connection instead of one or both mold halves, for example if a ceramic insulating layer 5, 6 is formed so thickly on one or both mold halves 2, 3 that current conduction via it is made difficult. As an alternative to this, the electrode may also be electrically insulated from the mold halves. During the subsequent solidifying phase, one option is to apply a voltage between the casting plunger 8 and the anvil 10, so that a butt of material in the casting chamber is kept liquid. As a result, a pressure is maintained in this butt of material, serving to provide dense feeding of the metal in the mold cavity during the solidifying process, so that a better or more dense microstructural composition of the metal is achieved. For this purpose, a current may additionally or alternatively be connected between the casting plunger 8 and/or casting chamber 7 and one or both mold halves 2, 3, or an electrode 12 or a slide 4, in order to keep the metal in the gate 11 liquid. In this case, insulating layers may be provided on electrodes for shielding from a mold part and/or insulating layers may be provided on current-carrying mold parts, such as for example the casting chamber 7, casting plunger 8, anvil 10, the mold halves 2, 3 and/or the slide 4, for insulation from other mold parts or the casting metal.

A current flow can also be maintained after the solidifying process, preferably for example between the mold halves or between the casting plunger and one or both mold halves. As a result, a thermal treatment can be achieved for improving the microstructure.

If a cast-in piece, not shown in the figure, is to be cast into the metal, it can, if it is electrically conducting, be used directly for the connection of the voltage. As an alternative to this, electrodes may be fitted to the cast part.

Welding current sources which deliver voltages of, for example, less than/equal to 100 V and currents of, for example, greater than/equal to 100 A, may be used for example as current sources, so that already existing devices can be used. In this case, starting-up and running-down curves may also be used for regulating the current intensity.

The method according to the invention can also be used, for example, for gravity-diecasting or sand-casting methods, the current being introduced from one casting mold half via another casting mold half or an electrode, or via a feeding device for the metal. Furthermore, use is possible for forging methods or drop-forging methods in which a current is advantageously fed in directly via the forging molds.

What is claimed is:

1. An improvement in a method of primary forming a metal by pressure die-casting, said method comprising the steps of loading molten metal into a casting chamber, filling a mold cavity with metal from the casting chamber by pressing a casting plunger into the casting chamber toward an anvil, the mold cavity comprising a two piece metal mold, cooling the metal inside the mold cavity to form a solid workpiece, optionally heat-treating the workpiece after solidification, and opening the mold by separating the mold halves to release the workpiece, the improvement comprising the steps of:

forming a first closed electrical circuit running through the metal between first and second electrodes, said first closed circuit being made operable by applying a voltage between said first and second electrodes during a first of said steps; and forming a second closed electrical circuit running through the metal between third and fourth electrodes, said second closed circuit being made operable by applying said voltage between said third and fourth electrodes during a second of said steps:

wherein at least one of said third and fourth electrodes is neither said first electrode nor said second electrode.

2. The improved method of claim 1, wherein said casting plunger serves as said first electrode and said second electrode is formed of said anvil, at least one of said mold pieces, or a wall of said casting chamber, said first step being said loading step.

3. The improved method of claim 1, wherein a wall of said casting chamber serves as said first electrode and said second electrode is formed of said anvil, one of said mold pieces, or a slide fitted in said mold piece, said first step being said loading step.

4. The improved method of claim 1, wherein one of said mold pieces serves as said third electrode and the fourth electrode is the other mold piece, said second step being said filling step.

5. The improved method of claim 4, wherein said casting plunger serves as said first electrode and said anvil serves as said second electrode, a wall of said casting chamber being grounded, said first step being said loading step.

6. The improved method of claim 4, wherein said mold pieces are ceramic and electrodes are fitted on said respective ceramic mold pieces, thereby serving as respective first and second electrodes.

7. The improved method of claim 1, wherein said second step is said cooling step and a current through said second circuit during said cooling step is responsive to an ultrasound measurement of said workpiece.

8. The improved method of claim 1, wherein said second step is said filling step and one of said mold pieces and a slide fitted therein serve as said third electrode and the other mold piece and another slide fitted therein serve as said fourth electrode.

9. The improved method of claim 1, wherein a current through said second circuit is responsive to measurement of temperature of metal in a gate between said casting chamber and said mold cavity so as to maintain the metal in said gate in liquid form.

10. The improved method of claim 5, wherein the temperature of a butt of material remaining between the casting plunger and the anvil in the solidifying step is measured and a voltage applied between the casting plunger and the anvil is automatically controlled in dependence on the measured temperature.

11. The improved method of claim 1, wherein a predetermined variation in voltage between said first and second electrodes or current through said first circuit is provided over time.

12. The improved method of claim 10, wherein the voltage is lowered over time during the solidifying step.

13. The improved method of claim 1, wherein a current through said second circuit is responsive to pressure of the metal measured in the mold cavity.

14. The improved method of claim 11, wherein during the loading and filling steps said voltage is less than/equal to 100 V and said current is greater than/equal to 100 A.

15. The improved method of claim 1, wherein electric current or electric power outputs corresponding to the applied voltages are measured and automatically controlled in dependence on one or more signals measuring parameters of the workpiece.

16. The improved method of claim 15, wherein said measuring signals are provided by temperature sensors.

17. An improvement in an apparatus for primary forming a metal workpiece by pressure die-casting, said apparatus comprising a casting chamber, a casting plunger for pushing molten metal in the casting chamber toward an anvil, a mold cavity comprising a two piece metal mold, and a gate for flow of said metal from the casting chamber to the mold cavity, the improvement comprising:

a first closed electrical circuit running through said metal between first and second electrodes, said first closed electrical circuit including means for applying a voltage between said first and second electrodes;

a second closed electrical circuit running through said metal between third and fourth electrodes, said second closed electrical circuit including means for applying said voltage between said third and fourth electrodes, wherein at least one of said third and fourth electrodes is neither said first electrode nor said second electrode; and means for controlling said voltage to supply current to said first closed circuit in a first phase of said pressure die casting and to said second closed circuit during a second phase of said pressure die casting.

18. The improved apparatus of claim 17, wherein said casting plunger serves as said first electrode, and said second electrode is formed of said anvil, at least one of said mold pieces, or a wall of said casting chamber, wherein said first closed circuit is operable during a loading phase, wherein the casting chamber is filled with molten metal.

19. The improved apparatus of claim 17, wherein a wall of said casting chamber serves as said first electrode, and said second electrode is formed of said anvil, one of said mold pieces, or a slide fitted in said mold piece, wherein said first closed circuit is operable during a loading phase, wherein the casting chamber is filled with molten metal.

20. The improved apparatus of claim 17, wherein said casting plunger serves as said first electrode, and said anvil serves as said second electrode, a wall of said casting chamber being grounded, wherein said first closed circuit is operable during a loading phase, wherein the casting chamber is filled with molten metal.

21. The improved apparatus of claim 20, wherein one of said mold pieces serves as said third electrode and said fourth electrode is the other mold piece, and wherein said second closed circuit is operable during a mold filling phase and a cooling phase of said pressure die casting.

22. The improved apparatus of claim 17, further comprising means for controlling current through one of said first and second closed circuits to be responsive to signals from temperature sensors fitted on the inside wall of said casting chamber and on the inside surface of said mold pieces.

23. The improved apparatus of claim 17 further comprising means for controlling current through said second circuit during a cooling phase to be responsive to an ultrasound measurement of said workpiece.

24. The improved apparatus of claim 17, further comprising means for controlling current through said second circuit is to be responsive to pressure of the metal measured in the mold cavity.

25. The improved apparatus of claim 17, further comprising means for providing a predetermined variation in voltage at said electrodes or current through said circuits over time.

26. The improved apparatus of claim 17, further comprising means for controlling a current is said second circuit to be responsive to measurement of temperature of metal in a gate between said casting chamber and said mold cavity so as to maintain the metal in said gate in liquid form.

* * * * *